US010041463B2

(12) United States Patent
Toriyama et al.

(10) Patent No.: US 10,041,463 B2
(45) Date of Patent: Aug. 7, 2018

(54) IGNITION DEVICE

(71) Applicant: DENSO CORPORATION, Kariya, Aichi-pref. (JP)

(72) Inventors: Makoto Toriyama, Kariya (JP); Shunichi Takeda, Kariya (JP); Kanechiyo Terada, Kariya (JP); Satoru Nakayama, Kariya (JP); Takashi Oono, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/302,552

(22) PCT Filed: Apr. 9, 2015

(86) PCT No.: PCT/JP2015/061058
§ 371 (c)(1),
(2) Date: Oct. 7, 2016

(87) PCT Pub. No.: WO2015/156342
PCT Pub. Date: Oct. 15, 2015

(65) Prior Publication Data

US 2017/0022961 A1 Jan. 26, 2017

(30) Foreign Application Priority Data

Apr. 10, 2014 (JP) ..... 2014-080625
Sep. 1, 2014 (JP) ..... 2014-176988
Feb. 19, 2015 (JP) ..... 2015-030160

(51) Int. Cl.
*F02P 15/10* (2006.01)
*F02P 3/08* (2006.01)
(Continued)

(52) U.S. Cl.
CPC ..... *F02P 3/08* (2013.01); *F02P 3/0442* (2013.01); *F02P 3/0892* (2013.01); *F02P 9/00* (2013.01);
(Continued)

(58) Field of Classification Search
CPC ..... F02P 15/10; F02P 3/08; F02P 3/0407
(Continued)

(56) References Cited

U.S. PATENT DOCUMENTS 8,813,732 B2 * 8/2014 Kataoka ..... F02P 3/051 123/621
2004/0154592 A1 * 8/2004 Fujima ..... F02P 3/0838 123/406.57
(Continued)

FOREIGN PATENT DOCUMENTS

JP H08-045753 2/1996
JP 2000-170632 6/2000
JP 2012-004238 1/2012

*Primary Examiner* — Mahmoud Gimie
(74) *Attorney, Agent, or Firm* — Nixon & Vanderhye PC

(57) ABSTRACT

According to an ignition device, a first switching unit applies a voltage between electrodes of by spark plug by turning on/off energization from an on-vehicle battery to a primary coil. Further, a second switching unit applies a voltage having the same direction as a spark discharge generated by turning on/off the first switching unit between the electrodes of the spark plug by supplying electrical energy accumulated in a booster circuit into a primary coil. Accordingly, it is possible to greatly reduce a complexity of the on/off switching of the first and second switching units compared to a conventional technology.

11 Claims, 6 Drawing Sheets

(51) Int. Cl.
*F02P 9/00* (2006.01)
*F02P 3/04* (2006.01)
*F02P 5/15* (2006.01)

(52) U.S. Cl.
CPC ..... *F02P 9/007* (2013.01); *F02P 15/10* (2013.01); *F02P 5/15* (2013.01)

(58) Field of Classification Search
USPC ..... 123/621, 622, 605
See application file for complete search history.

(56) References Cited

U.S. PATENT DOCUMENTS

| | | | | |
|---|---|---|---|---|
| 2012/0017881 | A1 | 1/2012 | Kataoka et al. | |
| 2012/0186569 | A1* | 7/2012 | Shimakawa ..... | F02P 15/10 123/644 |
| 2014/0360476 | A1* | 12/2014 | Huberts ..... | F02P 9/002 123/609 |

* cited by examiner

IGNITION DEVICE

This application is the U.S. national phase of International Application No. PCT/JP2015/061058 filed 9 Apr. 2015 which designated the U.S. and claims priority to JP Patent Application No. 2014-080625 filed 10 Apr. 2014, JP Patent Application No. 2014-176988 filed 1 Sep. 2014 and JP Patent Application No. 2015-030160 filed 19 Feb. 2015, the entire contents of each of which are hereby incorporated by reference.

TECHNICAL FIELD

The present invention relates to an ignition device used in an internal combustion engine.

BACKGROUND ART

An ignition device for an internal combustion engine supplying electrical energy from two ignition coils to a single spark plug is known (refer to Patent Document 1, for example). According to this technology, there is provided a first switching unit for turning on/off a power supply to a primary coil, which is one of the ignition coils, from an on-vehicle battery, and a second switching unit for turning on/off the power supply to another primary coil, which is another one of the ignition coils, from the on-vehicle battery. Then, so-called on/off switching based on a full transistor system of the first and second switching units is repeated alternately so that on-periods of the first and second switching units do not overlap. Thus, a stable discharge state with no interrupted discharge can be maintained.

However, according to the technique of Patent Document 1, when the On-periods of the first and second switching units are overlapped, a discharge current decreases rapidly and a spark discharge cannot be maintained, and conversely, when Off-periods of the first and second switching units are overlapped, discharge timings overlap, thus the discharge current increases rapidly causing significant damage to an electrode in the spark plug. Therefore, since in order for the on/off state of the first and second switching units to follow variation in individual parts or a change of spark timing due to differences in operating states of the internal combustion engine, it is necessary to perform the on/off switching with high accuracy, construction of control logic of the technology in the Patent Document 1 becomes complicated, and a calculation load in actual operation is considered to be large.

PRIOR ART

Patent Document

[Patent Document 1] Japanese Patent Application Laid-Open Publication No. 2012-041912

DISCLOSURE OF THE INVENTION

Problems to be Solved by the Invention

The present invention has been made in light of the problems set forth above and has as its object to provide an ignition device ignition device for an internal combustion engine that supplies electrical energy from two ignition coils to one spark plug to reduce a complexity regarding on/off switching of two switching units.

Means for Solving the Problems

In an ignition device for an internal combustion engine according to a first aspect, the ignition device supplies electrical energy from two ignition coils composed of a first ignition coil and a second ignition coil with respect to a single spark plug. The ignition device includes a first switching unit, a second switching unit, and a booster circuit.

The first switching unit starts a main ignition by applying a voltage between electrodes of the spark plug by turning on/off energization to a primary coil of the first ignition coil from an on-vehicle battery. The booster circuit boosts a voltage of the on-vehicle battery and accumulates the electrical energy. Further, the second switching unit superimposes a current having the same direction as the spark discharge generated by turning on/off the first switching unit between the electrodes of the spark plug by supplying the electrical energy accumulated in the booster circuit into the primary coil of the second ignition coil.

Then, a spark discharge having the same direction as the spark discharge generated by turning on/off the first switching unit is continued between the electrodes of the spark plug by supplying the electrical energy in the booster circuit into the primary coil of the second ignition coil by the second switching unit.

Thereby, firstly, it is possible to start the spark discharge between the electrodes of the spark plug by the operation based on the fully transistorized ignition by turning on/off the first switching unit. Then, it is possible to continue the spark discharge over any period of time remaining the same polarity by repeating the on/off of the second switching unit to sequentially supply the electrical energy of the booster circuit to the primary coil of the second ignition coil.

Therefore, it is not necessary to consider whether the on-periods of the first and second switching units overlap each other, and the off-periods of the first and second switching units do not overlap each other. Therefore, in the ignition device that supplies the electrical energy from two of the first and second ignition coils with respect to the single spark plug, it is possible to greatly reduce complexity regarding the on/off switching of the first and second switching units.

In the following description, a spark discharge generated by turning on/off a first switching unit is referred to as a main ignition, and a spark discharge continued by turning on/off a second switching unit, that is, a spark discharge following the main ignition is referred to as a continuous spark discharge.

Further, by varying the specifications of the two ignition coils composed of the first and second ignition coils according to respective functions, it is possible to ensure the ignitability, to enhance effects of maintaining stably the discharge current, and suppressing the plug electrode from wearing.

For example, since the first ignition coil is needed to apply a large voltage between the plug electrodes in order to initially generate the main ignition, it is preferable to increase a turn ratio of the coil, and since the second ignition coil is needed to maintain the discharge current, it is preferable to increase an inductance. Therefore, it is possible to ensure the ignitability, to enhance effects of maintaining stably the discharge current, and suppressing the plug electrode from wearing by setting the specifications of the first and second ignition coils according to requirements.

In the ignition device according to a second aspect, the primary coil of the second ignition coil has a first end and a second end, the first end is connected to a positive electrode of the on-vehicle battery, and the second end is connected to a ground via a freewheel diode. In addition, an energy supply line that supplies the electrical energy into the primary coil of the second ignition coil from the booster circuit is connected to a connection point of the primary coil of the second ignition coil and the freewheel diode.

Thereby, it is possible to reduce the electromotive force generated in the primary coil of the second ignition coil when the second switching unit is switched from on to off. That is, the electromotive force generated in the primary coil when turning off the second switching unit can be returned from the primary coil via the path of on-vehicle battery, the ground, the freewheel diode, and the primary coil in this order. Therefore, the continuation spark discharge in the spark plug can be stably continued without abrupt current change.

In the ignition device according to a third aspect, the primary coil of the second ignition coil has a first end and a second end, the first end is connected to a ground, the second end is connected to the ground via the freewheel diode. In addition, an energy supply line that supplies the electrical energy into the primary coil of the second ignition coil from the booster circuit is connected to a connection point of the primary coil of the second ignition coil and the freewheel diode.

Thus, regarding a path of a return of an electromotive force accompanying a switching on/off of a second switching unit, a potential at a destination from the primary coil can be reduced as compared to the second aspect. Therefore, since a boosting range of a boosting circuit can be lowered, it is possible to adopt various elements used for the booster circuit and various elements used for an energy supply line with a low withstanding voltage. As a result, reductions in cost and size of the ignition device, and an improved storage efficiency of the electrical energy in the booster circuit can be achieved.

In the ignition device according to a fourth aspect, the ignition device includes a magnet having a reversed bias polarity.

That is, the magnet is incorporated into a magnetic path that passes a magnetic flux generated by energization of a primary coil, and reverse-biases a core that forms the magnetic path.

Accordingly, a magnetic saturation is unlikely to occur in the core, and since it is possible to increase the energy that can be accumulated in the primary coil, it is possible to strengthen the main ignition.

In the ignition device according to a fifth aspect, the magnet is a first magnet, and the ignition device includes a second magnet having a reversed bias polarity.

That is, the second magnet is disposed separately from the first magnet, and is incorporated into a magnetic path that passes a magnetic flux generated by energization of a primary coil, and reverse-biases a core that forms the magnetic path.

Accordingly, a magnetic saturation is unlikely to occur in the core, and since it is possible to increase the energy that can be accumulated in the primary coil, it is possible to strengthen the continuity spark discharge.

BRIEF DESCRIPTION OF THE DRAWINGS

FIG. 4(*b*) shows an explanatory diagram of a state in which a core passing through a magnetic flux generated by energization of a continuous spark discharge of a primary coil is reverse-biased (second embodiment);

MODE FOR CARRYING OUT THE INVENTION

Hereinafter, modes for carrying out the invention are described with reference to embodiments. It should be noted that embodiments are given to disclose a specific example, and needless to say that the present invention is not limited to the embodiments.

[Configuration of First Embodiment]

Figure 1:
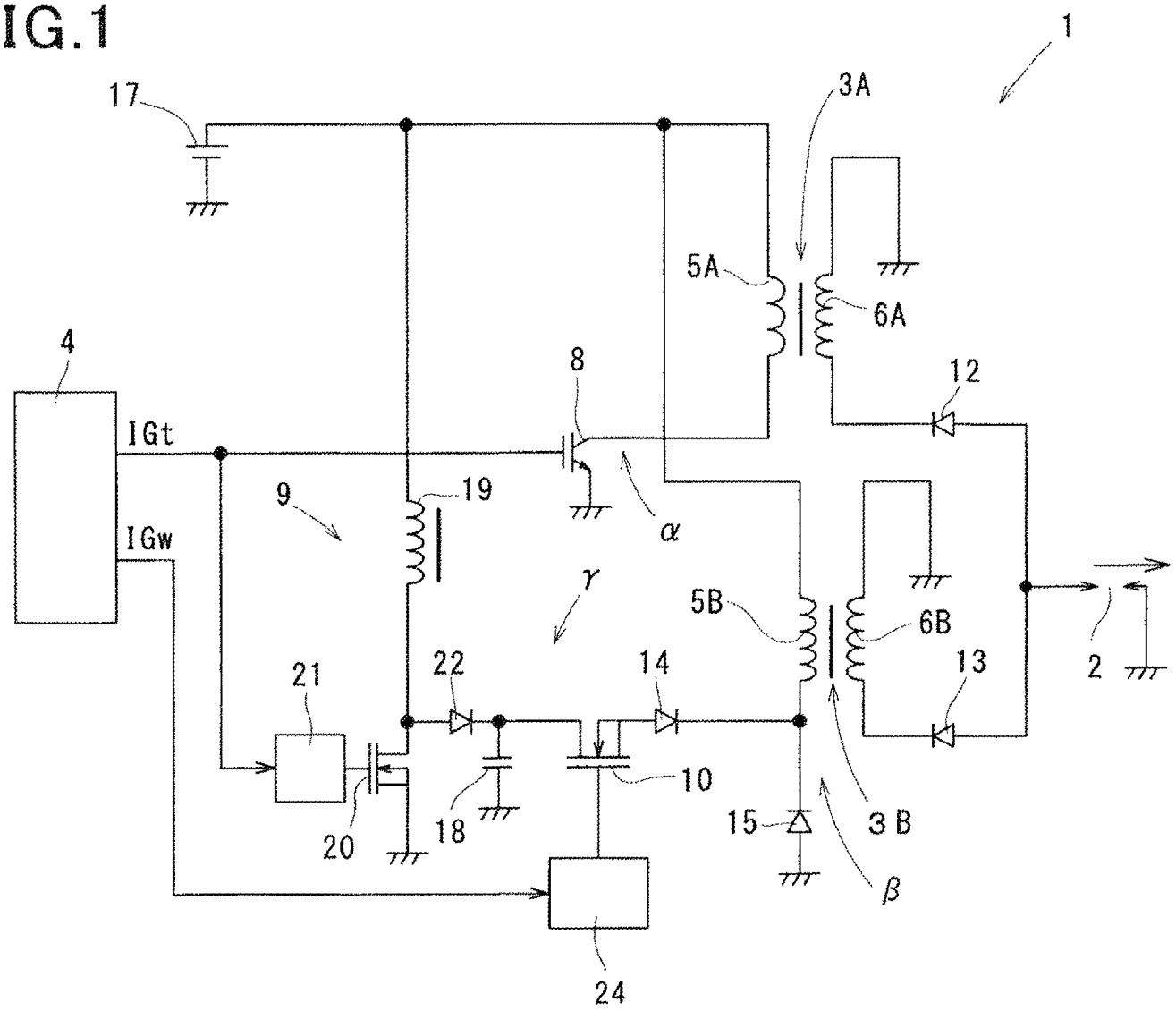
FIG. 1 shows a schematic configuration diagram of an ignition device (first embodiment)

An ignition device 1 of a first embodiment will be described with reference to FIG. 1.

The ignition device 1 is intended to be mounted on a spark ignition engine for moving a vehicle, and ignites an air-fuel mixture in a combustion chamber at a predetermined ignition timing. It should be noted that one example of such an engine is a direct injection engine capable of lean burn using gasoline as fuel, equipped with a swirl flow control means for creating a swirling flow of the air-fuel mixture such as tumble flow or swirl flow in a cylinder. Then, in an operating state of having a possibility of blowout of spark discharge due to a high gas flow rate in the cylinder such as a lean burn, the ignition device 1 is controlled to perform a continuous spark discharge following a main ignition.

Furthermore, an ignition device 1 is a DI (direct Ignition) type that is intended to supply electrical energy from two ignition coils composed of a first ignition coil 3A and a second ignition coil 3B with respect to a single spark plug 2 for each cylinder.

Furthermore, the ignition device 1 is intended to control energization of primary coils 5A and 5B of the ignition coils 3A and 3B, respectively, based on signals such as an ignition signal IGt and a discharge continuation signal IGw given from an electronic control unit (hereinafter, referred to as ECU 4.) that constitutes a core of an engine control. Then, the spark discharge of the spark plug 2 is controlled by controlling electrical energy generated in secondary coils 6A and 6B of the ignition coils 3A and 3B, respectively, by controlling energization of the primary coils 5A and 5B.

Here, signals from various sensors for detecting parameters indicating an operating state and a control state of the engine (a warming up state, an engine speed, an engine load, a presence or absence of the lean burn, a degree of the swirling flow, or the like) is inputted to the ECU 4. Further, the ECU 4 is configured to include an input circuit for processing the inputted signals, a CPU for performing control processing and calculation processing related to an engine control based on the inputted signal, various memories for memorizing and storing data and programs required for the engine control, an output circuit for outputting a signal required for engine control based on processed results of the CPU, and the like. Then, the ECU 4 generates and outputs the ignition signal IGt and the discharge continuation signal IGw according to the engine parameters acquired from various sensors.

The ignition device 1 of the first embodiment includes the spark plug 2, the first and second ignition coils 3A and 3B, a first switching unit 8, a booster circuit 9, a second switching unit 10, and the first to fourth diodes 12-15, which will be described below.

First, the spark plug 2 is that having a known structure including a center electrode and a ground electrode. Each of the secondary coils 6A and 6B has a first end and a second end, and the center electrode is connected to the respective first ends of the secondary coils 6A and 6B. The ground electrode is grounded via a cylinder head of the engine. Then, the spark plug 2 generates the spark discharge between the center electrode and the ground electrode by the electric energy generated in the secondary coils 6A and 6B.

Each of the first and second ignition coils 3A and 3B has the primary coils 5A and 5B and the secondary coils 6A and 6B, respectively, and is a well-known structure that generates a current (secondary current) in the secondary coils 6A and 6B by electromagnetic induction in accordance with an increase and decrease of a current (primary current) flowing through the primary coils 5A and 5B. Here, each of the primary coil 5A and 5B has a first end and a second end, respectively, and both of the first ends are connected to a positive electrode of the on-vehicle battery 17, while the second ends are connected to ground via a variety of electronic elements (hereinafter, lines connecting the respective second end of the primary coils 5A and 5B to the ground may be referred to as ground lines α and β, respectively). Further, each of the secondary coils 6A and 6B has a first end and a second end, respectively, and both of first ends are connected to the center electrode of the spark plug 2, while the second ends are connected to the ground.

The first switching unit 8 is provided on the ground line α, and it is intended to turn on/off the energization of the on-vehicle battery 17 to the primary coil 5A, and it turn on the energization to the primary coil 5A in a period in which the ignition signal IGt is applied from ECU 4. Here, the ignition signal IGt is a signal for turning on the energization in the primary coil 5A, and more specifically, it is a signal instructing a period to let the primary coil 5A to accumulate magnetic energy. It should be noted that the first switching unit 8 is a power transistor, a MOS transistor, a thyristor, or the like.

Then, the voltage of the in-on-vehicle battery 17 is applied to the primary coil 5A and a positive primary current is energized by the first switching unit 8 being turned on during a period when the ignition signal IGt is given from the ECU 4, thus the magnetic energy is accumulated in the primary coil 5A. Thereafter, by turning the first switching unit 8 off, a high voltage is generated in the secondary coil 6A by converting the magnetic energy accumulated in the primary coil 5A into electrical energy using electromagnetic induction, while the high voltage is applied between the electrodes of the spark plug 2, thus causing the main ignition.

The boosting circuit 9 is intended to boost the voltage of the on-vehicle battery 17 and accumulate the voltage in a capacitor 18 as the electrical energy, and it boosts the voltage of the on-vehicle battery 17 and accumulates it during a period in which the ignition signal IGt is given from the ECU 4. Further, the booster circuit 9 is configured to include a choke coil 19, a boost switching unit 20, a boost driver circuit 21, and a diode 22 in addition to the capacitor 18. Incidentally, the boost switching unit 20 is, for example, a MOS type transistor.

Here, one end of the choke coil 19 is connected to the positive electrode of the on-vehicle battery 12, and an energized state of the choke coil 19 is intermitted by the boost switching unit 20. Further, the boost driver circuit 21 is for turning on/off the boost switching unit 20 by giving a control signal to the boost switching unit 20, and by the on/off operation of the boost switching unit 20, the magnetic energy accumulated in the choke coil 19 is charged in the capacitor 18 as the electrical energy.

It should be noted that the boost driver circuit 21 is configured so as to turn on and off repeatedly the boost switching unit 20 at predetermined intervals during a period in which the ignition signal IGt is given from the ECU 4. Further, the diode 22 is for preventing the electrical energy accumulated in the capacitor 18 from flowing back to the choke coil 19 side.

The second switching unit 10 supplies the electrical energy accumulated in the booster circuit 9 by the on operation. Thereby a current having the same direction as the spark discharge generated by turning on/off the first switching unit 8 is added by superimposing between the electrodes of the spark plug 2 by into the primary coil 5B, thus the continues spark discharge following the main ignition is continued. More specifically, the second switching unit 10 is intended to be turned on by a control signal supplied from the driver circuit 24, and is provided on the following energy supply line γ.

That is, the energy supply line γ is connected to the ground line β, and is a line for supplying the electrical energy of the booster circuit 9 from the second end (negative side) of the primary coil 5B. Further, the driver circuit 24 is intended to output the high/low of the control signal by switching it repeatedly during a period to which the discharge continuation signal IGw is given from the ECU 4. Here, the discharge continuation signal IGw is a signal for controlling a duration of continuing the continuous spark discharge, and more specifically, it is a signal that controls a period to supply the electrical energy to the primary coil 5B from the booster circuit 9 by the second switching unit 10 repeating the turning on/off by the driver circuit 24.

Then, the second switching unit 10 repeats the on/off switching during the period where the discharge continuation signal IGw is given from ECU 4 to sequentially supply the electrical energy of the booster circuit 9 to the primary coil 5B, and thereby, the continuous spark discharge is continued.

It should be noted that the second switching unit 10 is a power transistor, a MOS transistor, a thyristor, or the like.

The first and second diodes 12 and 13 are respectively disposed between the center electrodes of the ignition plug 2 and the secondary coils 6A and 6B, and limit directions of discharge currents in the main ignition and the continuous spark discharge to be the same direction. That is, the first and second diodes 12 and 13 are disposed so that a discharge current when the secondary current flows through the secondary coil 6A by switching on/off the first switching unit 8 and a discharge current when secondary current flows through the secondary coil 6B by switching on/off the second switching unit 10 are in the same direction.

In addition, the third diode 14 is disposed to a negative side of the second switching unit 10 in the energy supply line γ, and it is intended to prevent the current from flowing reversely to the booster circuit 9 from the primary coil 5B.

Further, the fourth diode 15 is disposed on the ground line β closer to a ground side than a connection point to the energy supply line γ is, and operates as a freewheel diode when switching the second switching unit 10 off from on. That is, the fourth diode 15 returns an electromotive force generated in the primary coil 5B when turning off the second switching unit 10 from the primary coil 5B via a path of on-vehicle battery 17, the ground, the fourth diode 15, and the primary coil 5B.

Next, operation of the ignition device 1 will be described with reference to FIG. 2.

Figure 2:
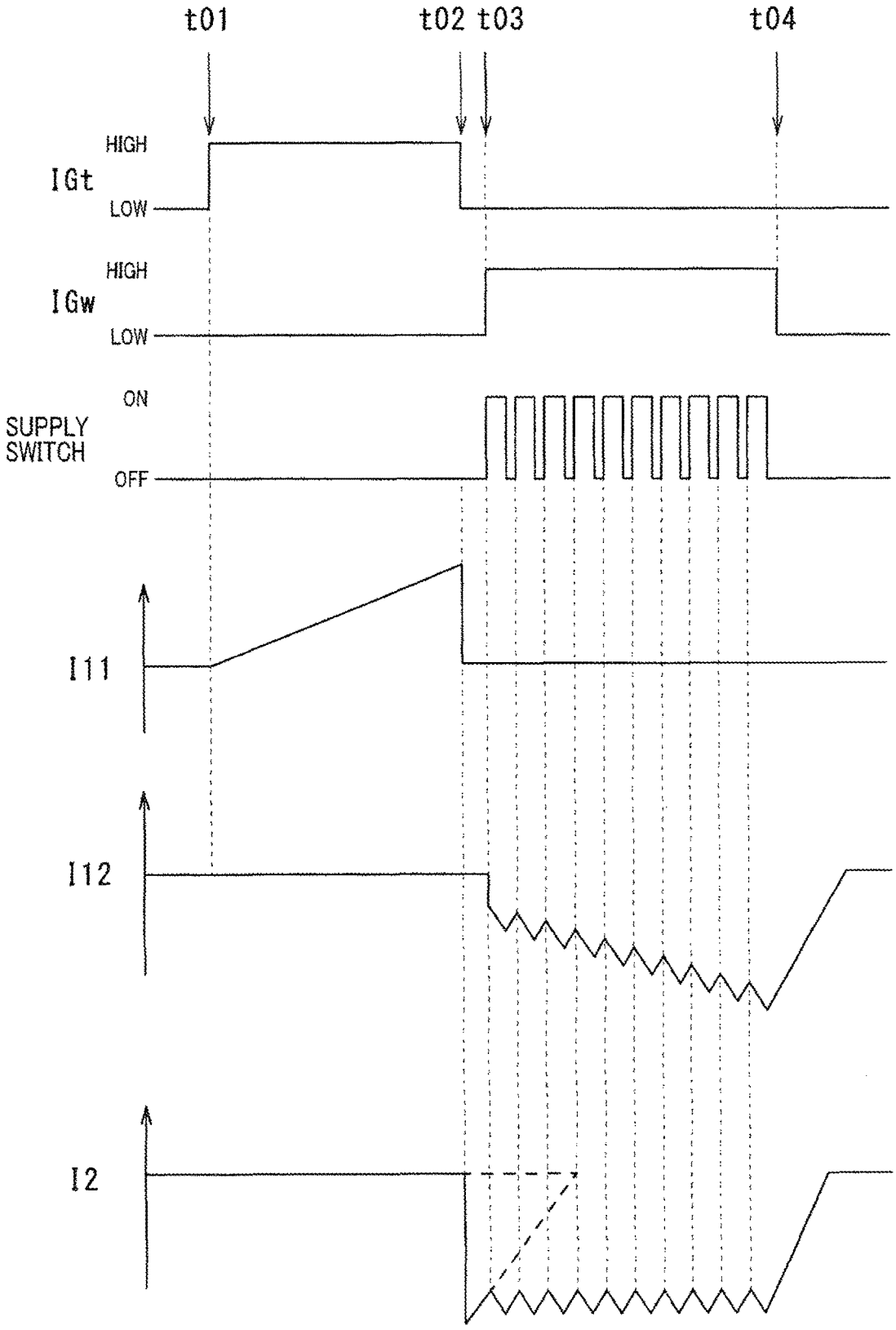
FIG. 2 shows a time chart describing an operation of the ignition device (first embodiment)

Note that in FIG. 2, IGt is intended to represent an input state of the ignition signal IGt by high/low, and IGw is intended to represent an input state of the discharge continuation signal IGw by high/low. Further, a term SUPPLY SWITCH represents the on/off of the second switching unit 10, I11 and I12 respectively represent a value of the primary current flowing in the primary coils 5A and 5B, and 12 represents a value of the discharge current.

When the ignition signal IGt is switched from low to high (refer to time t01), the first switching unit 8 maintains the on-state and the positive primary current flows in the primary coil 5A during a period when the ignition signal IGt is high, and thus the magnetic energy is accumulated in the primary coil 5A. In addition, the electrical energy is accumulated in the booster circuit 9.

Eventually, when the ignition signal IGt is switched from high to low (refer to time t02), the first switching unit 8 is turned off, and the energization of the primary coil 5A is cut off. Accordingly, the magnetic energy accumulated in the primary coil 5A is converted into electrical energy and the high voltage is generated in the secondary coil 6, and thus the main ignition is started in the spark plug 2.

After the main ignition is initiated in the spark plug 2, the discharge current is attenuated at a substantially triangular waveform. Then, before the discharge current reaches a lower limit threshold (a lower limit of the current value required to maintain the spark discharge), the discharge continuation signal IGw is switched from low to high (refer to time t03).

When the discharge continuation signal IGw is switched from low to high, the second switching unit 10 is turned on/off, and the electrical energy accumulated in the booster circuit 9 is sequentially charged into the negative side of the primary coil 5B, thus the primary current flows from the primary coil 5B to the positive electrode of the on-vehicle battery 17. More specifically, every time the second switching unit 10 is turned on, the primary current from the primary coil 5B to the positive electrode of the on-vehicle battery 17 is added, and the primary current increases to the negative side (refer to time t03 to t04).

Then every time the primary current it is added to the primary coil 5B, the secondary current is sequentially added to the secondary coil 6B, thereby the discharge current is maintained in the same direction as the main ignition at a substantially constant value. As a result, the spark discharge generated as the main ignition continues as the continuous spark discharge.

[Effects of the First Embodiment]

The ignition device 1 of the first embodiment is intended to supply the electrical energy from two of the first and second ignition coils 3A and 3B with respect to the single spark plug 2, and has the following the first switching unit 8 and the second switching unit 10. First, the first switching unit 8 applies a voltage between the electrodes of the spark plug 2 by turning on/off the energization from the on-vehicle battery 17 to the primary coil 5A. Further, the second switching unit 10 applies a voltage having the same direction of the voltage generated by turning on/off the first switching unit 8 between the electrodes of the spark plug 2 by supplying the electrical energy accumulated in the booster circuit 9 to the primary coil 5B.

Then, the main ignition is started by applying the voltage between the electrodes of the spark plug 2 by turning on/off the first switching unit 8, and the electrical energy of the booster circuit 9 is sequentially applied to the primary coil 5B by repeatedly turning on/off the second switching unit 10, so that the voltages in the same direction are continuously applied between the electrodes the spark plug 2, thereby the continuous spark discharge continues after the main discharge.

Thus, after starting the main ignition by the operation based on the full transistor ignition by turning on/off the first switching unit 8, the electrical energy is supplied to the primary coil 5B before the main ignition disappears by repeatedly turning on/off the second switching unit 10, thereby it is possible to continue the continuous spark discharge over any period of time.

Therefore, in the ignition device 1 that supplies the electrical energy from two of the first and second ignition coils 3A and 3B with respect to the single spark plug 2, it is not necessary to pay attention that the on-periods of the first and second switching units 8 and 10 do not overlap each other, and the off-periods of the first and second switching units 8 and 10 do not overlap each other. Accordingly, it is possible to greatly reduce a complexity regarding the on/off of the first and second switching units 8 and 10 compared to the conventional technology.

In addition, since the first and second ignition coils 3A and 3B are disposed respectively for the main ignition and for the continuous spark discharge individually, a eat generated accompanying the energization of the main ignition and a heat generated accompanying the energization of the continuous spark discharge can be dispersed. Thereby, the ignition device 1 can be downsized. In addition, since it is possible to increase the secondary current to the level required for the ignition earlier by matching the time t02 to switch the ignition signal IGt from high to low and the time t03 to switch the discharge continuation signal IGw from low to high, the ignitability can be further improved.

Furthermore, it is possible to select whether to generate the main ignition only or to continue the continuous spark discharge in the main ignition in accordance with the operating state of the engine. Therefore, it is possible to select optimal aspects of the ignition according to the operating state of the engine.

Further, by varying the specifications of the first and second ignition coils 3A and 3B according to respective functions, it is possible to ensure the ignitability, to enhance effects of maintaining stably the discharge current, and suppressing the plug electrode from wearing.

For example, since the first ignition coil 3A is needed to apply a large voltage between the plug electrodes in order to initially generate the main ignition, it is preferable to increase a turn ratio of the coil, and since the second ignition coil 3B is needed to maintain the discharge current, it is preferable to increase an inductance.

Therefore, it is possible to ensure the ignitability, to enhance effects of maintaining stably the discharge current, and suppressing the plug electrode from wearing by setting the specifications of the first and second ignition coils 3A and 3B according to the needs.

Further, the second end of the primary coil 5B is connected to the ground via the fourth diode 15, which operates as the freewheel diode, and the energy supply line γ. In other words, the fourth diode 15 operating as the freewheel diode is incorporated to the ground line β closer to the ground side than the connection point to the energy supply line γ is.

Thereby, it is possible to lighten the electromotive force generated in the primary coil 5B when the second switching unit 10 is switched from on to off. That is, the electromotive force generated in the primary coil 5B when turning off the second switching unit 10 can be returned from the primary coil 5B via the path of on-vehicle battery 17, the ground, the freewheel diode 15, and the primary coil 5B. Therefore, it is possible to avoid an outage of the secondary current and keep continuing the continuous spark discharge stably.

[Second Embodiment]

Figure 3:
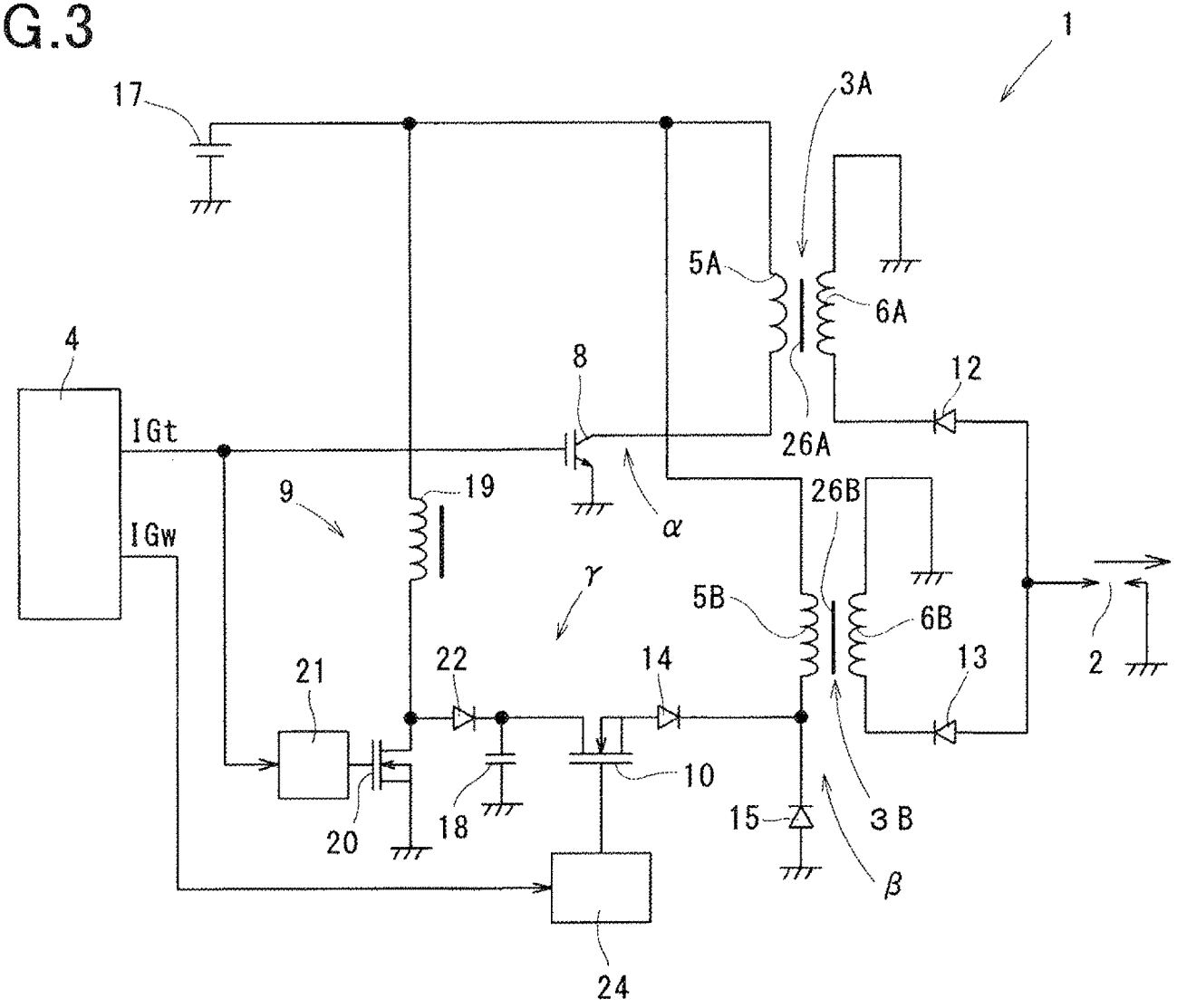
FIG. 3 shows a schematic configuration diagram of an ignition device (second embodiment)
Figure 4A:
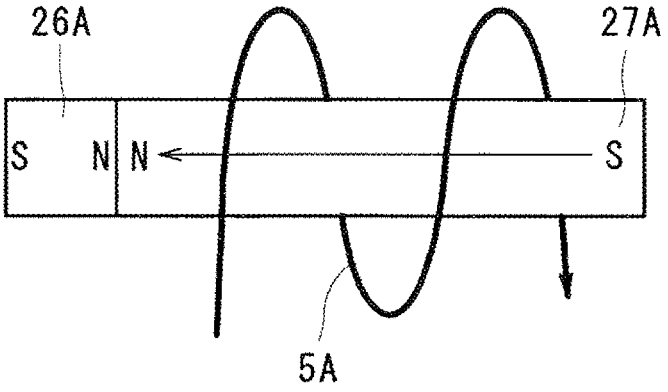
FIG. 4(*a*) shows an explanatory diagram of a state in which a core passing through a magnetic flux generated by energization of a main ignition of a primary coil is reverse-biased (second embodiment)
Figure 4B:
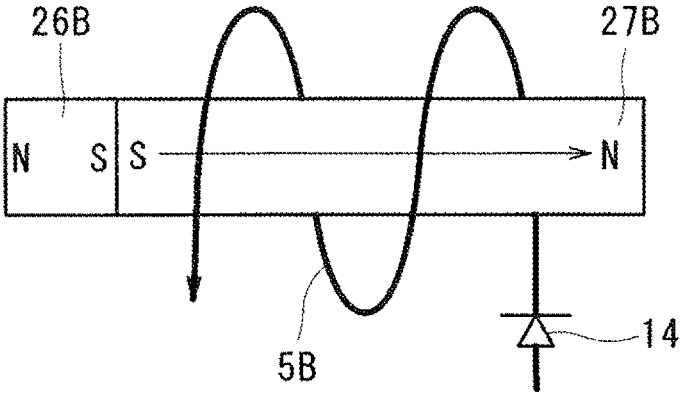

A second embodiment will be described with reference to FIG. 3, FIG. 4 (*a*) and FIG. 4 (*b*) mainly on points different from the first embodiment. Note that the same reference numerals as the first embodiment in the second embodiment show the same functions thereof.

An ignition device 1 of the second embodiment includes first and second magnets 26A and 26B with reversed bias polarities, which will be described below. First, the first magnet 26A is incorporated into a core 27A that passes a magnetic flux generated by energization of a primary coil 5A, and reverse-biases the core 27A. Further, the second magnet 26B is disposed separately from the first magnet 26A, and is incorporated into a core 27B that passes a magnetic flux generated by energization of a primary coil 5B, and reverse-biases the core 27B.

That is, when generating the main ignition, the core 27A is reverse-biased by the first magnet 26A, and since a variation width of a magnetic flux density B until reaching a magnetic saturation point Bs is large (refer to variation change widths ΔB0, ΔBa in FIG. 5), it is possible to increase an energy accumulated in the primary coil 5A. Further, when continuing the continuous spark discharge, the core 27B is reverse-biased by the second magnet 26B, and since the variation width of the magnetic flux density B until reaching the magnetic saturation point Bs is large (refer to variation change widths ΔB0, ΔBb in FIG. 5), it is possible to increase an energy accumulated in the primary coil 5B.

Thereby, the first magnet 26A can be incorporated in a direction to strengthen the main ignition, and with strength to strengthen the main ignition, while the second magnet 26B can be incorporated in a direction to strengthen the continuous spark discharge in the same polarity as the main ignition, and with strength to strengthen the continues spark discharge. As a result, it is possible to increase performances of the first and second ignition coils 3A and 3B individually by the first and second magnets 26A and 26B, respectively.

Figure 5:
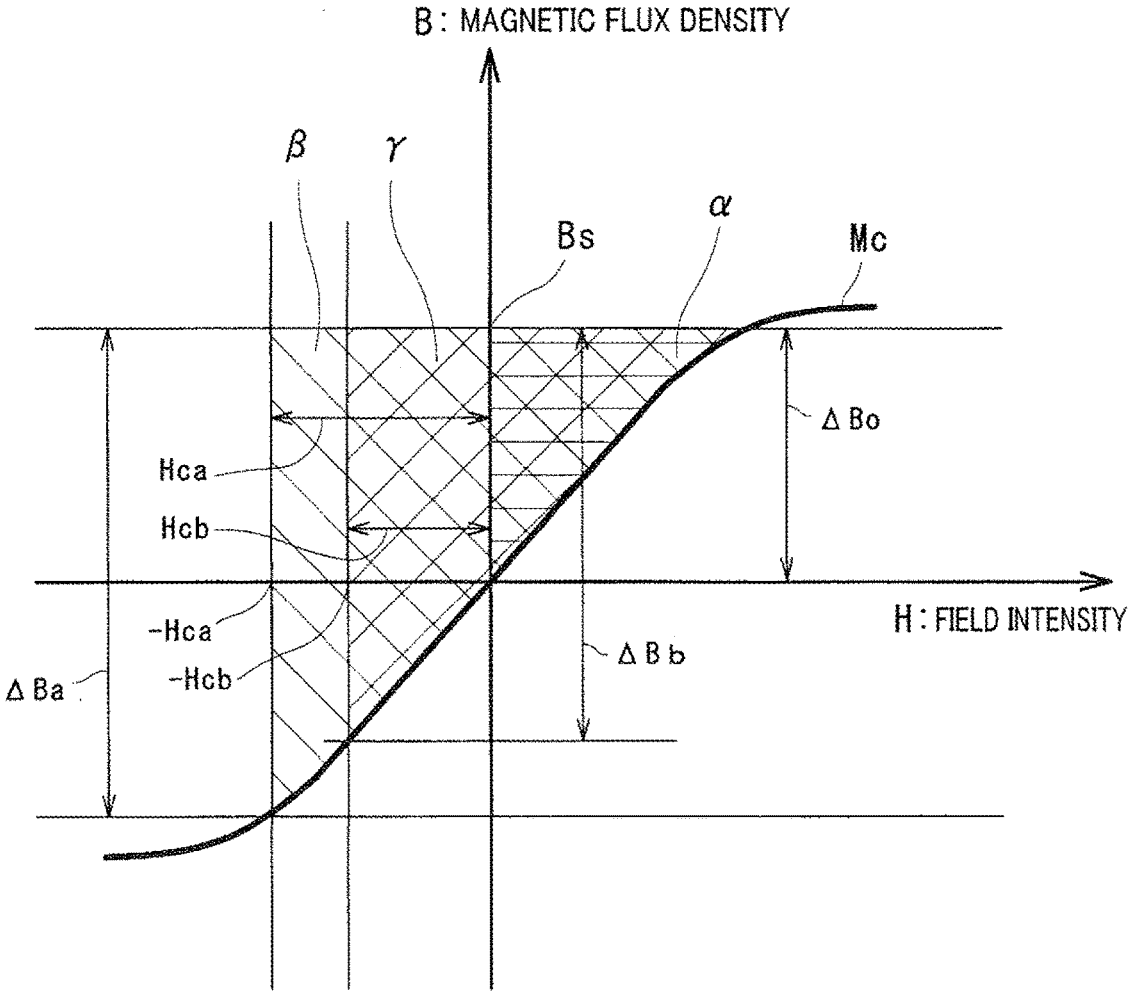
FIG. 5 shows a magnetization characteristic diagram describing an energy increase due to a reverse bias accompanying a magnet use (second embodiment)

For example, an energy that can be accumulated in the primary coil 5A when the core 27A is not reverse-biased by the first magnet 26A, and an energy that can be accumulated in the primary coil 5B when the core 27B is not reverse-biased by the second magnet 26B correspond to an area of a region α surrounded by a vertical axis, a magnetization curve Mc, and a horizontal line of B=magnetic saturation point Bs in FIG. 5.

In contrast, a case of incorporating the first and second magnets 26A26B into the respective cores 27A and 27B for the strengthening of the main ignition and the continuous spark discharge will be considered. Here, since a large energy is required for generating the main ignition than continuing the continuous spark discharge, a magnetizing force Hca of the first magnet 26A is configured larger than a magnetizing force Hcb of the second magnet 26B.

Thus, an energy that can be accumulated in the primary coil 5A when the core 27A is reverse-biased by the first magnet 26A correspond to an area of a region β surrounded by a vertical line of H=−Hca, the magnetization curve Mc, and the horizontal line of B=magnetic saturation point Bs in FIG. 5. Further, an energy that can be accumulated in the primary coil 5B when the core 27B is reverse-biased by the first magnet 26B correspond to an area of a region γ surrounded by a vertical line of H=−Hcb, the magnetization curve Mc, and the horizontal line of B=magnetic saturation point Bs in FIG. 5.

With the above, the energy accumulated in the primary coil 5A and 5B can be increased by the first and second magnets 26A and 26B, respectively, and further, the energy accumulated in the primary coil 5A can be larger than the energy accumulated in the primary coil 5B.

[Third Embodiment]

A third embodiment will be described with reference to FIG. 6 mainly on points different from the first embodiment. Note that the same reference numerals as the first embodiment in the third embodiment show the same functions thereof.

Figure 6:
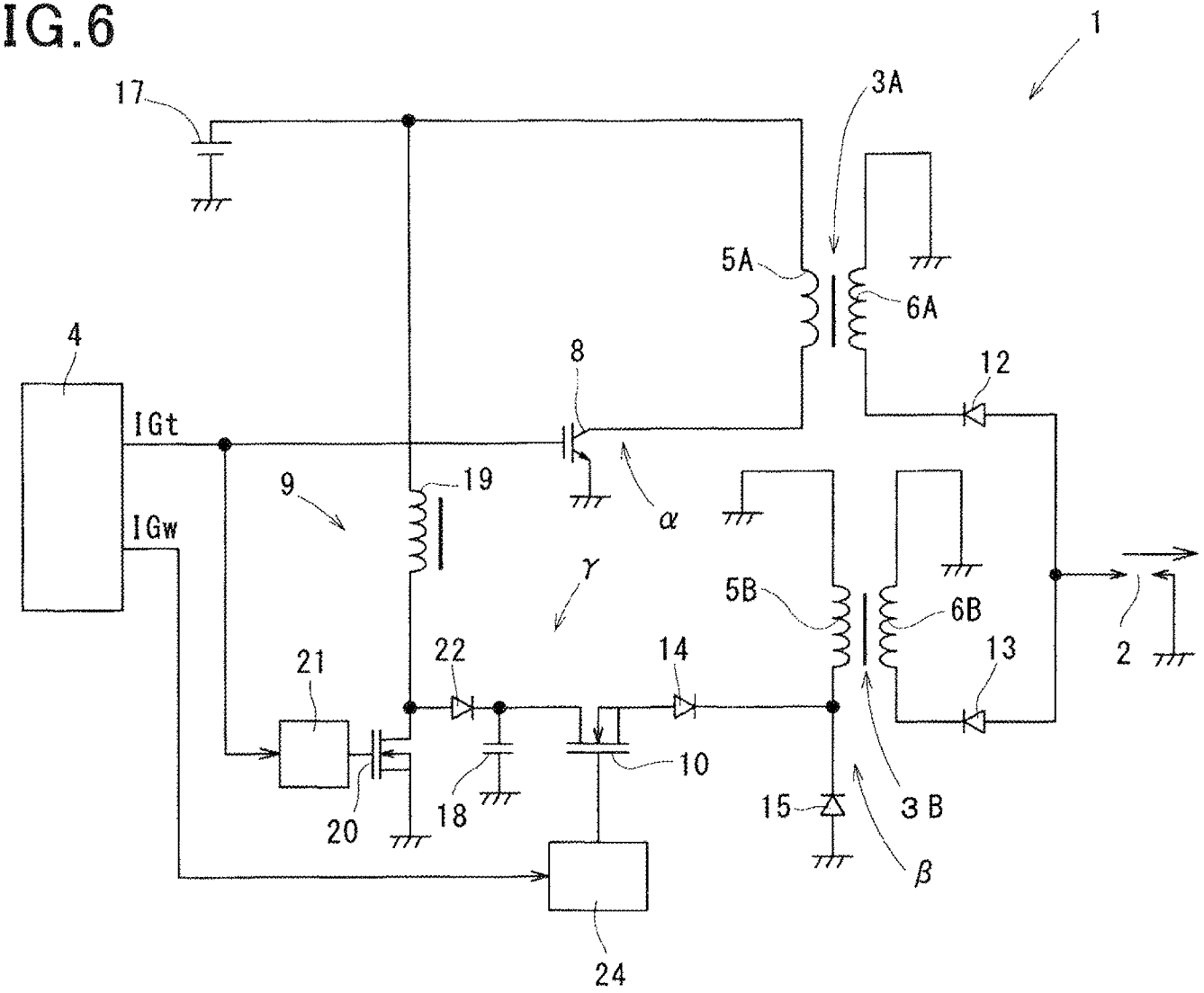
FIG. 6 shows a time chart describing an operation of the ignition device (third embodiment).

According to an ignition device 1 of a third embodiment, as shown in FIG. 6, a first end of a primary coil 5B is connected to a ground.

Thus, regarding a path of a return of an electromotive force accompanying a switching on/off of a second switching unit 10, a potential at a destination from the primary coil 5B can be reduced as compared to the first embodiment. Therefore, since a boosting range of a boosting circuit 9 can be lowered, it is possible to adopt various elements used for the booster circuit 9 (a capacitor 18, a boost switching unit 20 and a diode 22, etc.) and a second switching unit 10 used for an energy supply line γ with a low withstanding voltage. As a result, reductions in cost and size of the ignition device 1, and an improved storage efficiency of the electrical energy in the booster circuit 9 can be achieved.

[Modifications]

Although the first and second magnets 26A and 26B are incorporated into the respective cores 27A and 27B to strengthened both the main ignition and the continuous spark discharge in the above embodiment, an incorporation of the second magnet 26B may be omitted to reduce the cost by limiting an amount of current supplied to the primary coil 5B so that the core 27B does not become magnetically saturated, for example.

Although an example of applying the ignition device 1 of the present invention to a gasoline engine is described in the above embodiments, since an ignitability of the fuel (specifically an air-fuel mixture) can be improved by the continuous spark discharge, it may be applied to engines using ethanol fuel or mixed fuel. Further, the ignitability by continuous spark discharge can also be improved even if applied to an engine that may use inferior fuel.

Although an example of applying the ignition device 1 of the present invention to an engine capable of the lean burn operation is described in the above embodiments, since the ignitability by continuous spark discharge can be improved even in different combustion states from lean burn, it is not limited to the application to the engine capable of lean-burn, but may be applied to an engine that does not perform lean burn.

Although an example of applying the ignition device 1 of the present invention in a direct injection engine that injects fuel directly into a combustion chamber is described in the above embodiments, it may be applied to a port-injection type engine to which fuel is injected into an intake upstream side of an intake valve (into an intake port).

Although an example of applying the ignition device 1 of the present invention in an engine that actively produces swirling flow (the tumble flow or swirl flow, etc.) of the gas mixture in the cylinder is disclosed in the above embodiments, it may be applied to an engine that does not have swirling flow control means (a tumble flow control valve or a swirl flow control valve, etc.).

Although the present invention is applied to the DI type ignition device 1 in the above embodiments, the present invention may be applied to an ignition device 1 of a distributor type that distributes and supplies the secondary voltage each spark plug 2, or a an ignition device 1 of a single-cylinder engine (a motorcycle or the like, for example) that does not need a secondary voltage distribution.

REFERENCE SIGNS LIST

1: ignition device
2: spark plug
3A and 3B: first and second ignition coils
5A and 5B: primary coils
8: first switching unit
9: booster circuit
10: second switching unit
17: on-vehicle battery

The invention claimed is:

1. An ignition device for an internal combustion engine that supplies electrical energy from two ignition coils composed of a first ignition coil and a second ignition coil with respect to a single spark plug, the ignition device comprising:

a first switching unit that starts a main ignition by applying a voltage between electrodes of the spark plug by turning on and off energization to a primary coil of the first ignition coil from an on-vehicle battery;

a booster circuit that boosts a voltage of the on-vehicle battery and accumulates the electrical energy; and a second switching unit that superimposes a current having the same direction as the spark discharge generated by turning on and off the first switching unit between the electrodes of the spark plug by supplying the electrical energy accumulated in the booster circuit into the primary coil of the second ignition coil; wherein, a spark discharge having the same direction as the spark discharge generated by turning on and off the first switching unit is continued between the electrodes of the spark plug by supplying the electrical energy in the booster circuit into a negative side of the primary coil of the second ignition coil by the second switching unit.

2. The ignition device according to claim 1, wherein, the primary coil of the second ignition coil has a first end and a second end, the first end is connected to a positive electrode of the on-vehicle battery, the second end is connected to a ground via a freewheel diode, wherein the second end of the primary coil of the second ignition coil is on the negative side of the primary coil of the second ignition coil; and an energy supply line that supplies the electrical energy into the primary coil of the second ignition coil from the booster circuit is connected to a connection point of the primary coil of the second ignition coil and the freewheel diode.

3. The ignition device according to claim 1, wherein, the primary coil of the second ignition coil has a first end and a second end, the first end is connected to a ground, the second end is connected to the ground via the freewheel diode, wherein the second end of the primary coil of the second ignition coil is on the negative side of the primary coil of the second ignition coil; and an energy supply line that supplies the electrical energy into the primary coil of the second ignition coil from the booster circuit is connected to a connection point of the primary coil of the second ignition coil and the freewheel diode.

4. The ignition device according to claim 1, wherein, the ignition device includes a magnet having a reversed bias polarity that is incorporated into a magnetic path where a magnetic flux generated by energization of the primary coil of the first ignition coil passes.

5. The ignition device according to claim 4, wherein the magnet is a first magnet; and the ignition device includes a second magnet provided separately from the first magnet having a reversed bias polarity that is incorporated into a magnetic path where a magnetic flux generated by energization of the primary coil of the first ignition coil passes.

6. The ignition device according to claim 2, wherein, the ignition device includes a magnet having a reversed bias polarity that is incorporated into a magnetic path where a magnetic flux generated by energization of the primary coil of the first ignition coil passes.

7. The ignition device according to claim 6, wherein the magnet is a first magnet; and the ignition device includes a second magnet provided separately from the first magnet having a reversed bias polarity that is incorporated into a magnetic path where a magnetic flux generated by energization of the primary coil of the first ignition coil passes.

8. The ignition device according to claim 3, wherein, the ignition device includes a magnet having a reversed bias polarity that is incorporated into a magnetic path where a magnetic flux generated by energization of the primary coil of the first ignition coil passes.

9. The ignition device according to claim 8, wherein the magnet is a first magnet; and the ignition device includes a second magnet provided separately from the first magnet having a reversed bias polarity that is incorporated into a magnetic path where a magnetic flux generated by energization of the primary coil of the first ignition coil passes.

10. The ignition device according to claim 1, wherein, a turn ratio of the primary coil of the second ignition coil is smaller than a turn ratio of the primary coil of the first ignition coil.

11. The ignition device according to claim 1, wherein the supplying of the electrical energy in the booster circuit into the negative side of the primary coil of the second ignition coil causes a current to flow from the primary coil of the second ignition coil to the positive electrode of the on-vehicle battery.

* * * * *